United States Patent [19]

Hughes et al.

[11] 4,236,778

[45] Dec. 2, 1980

[54] TERMINAL BLOCK

[75] Inventors: Richard L. Hughes, Clemmons; Melvin A. Soderstrom; Advance; Vasantrai A. Vachhani; Lawrence P. Weisenburger, both of Kernersville, all of N.C.

[73] Assignee: AMP Incorporated, Harrisburg, Pa.

[21] Appl. No.: 61,722

[22] Filed: Jul. 30, 1979

Related U.S. Application Data

[63] Continuation-in-part of Ser. No. 47,840, Jun. 12, 1970, abandoned.

[51] Int. Cl.[3] ..... H01R 9/24; H01R 13/585

[52] U.S. Cl. ..... 339/97 P; 339/103 M; 339/107; 339/198 R; 339/198 H

[58] Field of Search ..... 339/96, 98, 97 R, 97 C, 339/97 P, 99, 103 M, 107, 198 R, 198 G, 198 GA, 198 H

[56] References Cited

U.S. PATENT DOCUMENTS

| | | | |
|---|---|---|---|
| 2,478,143 | 8/1949 | Watts | 173/324 |
| 2,909,756 | 10/1959 | Sitz | 339/198 |
| 3,992,072 | 11/1976 | Anhalt et al. | 339/97 P |
| 4,141,618 | 2/1979 | Reavis, Jr. et al. | 339/97 P |
| 4,171,862 | 10/1979 | Krasser | 339/198 H |
| 4,195,194 | 3/1980 | Kuster et al. | 339/97 R |

FOREIGN PATENT DOCUMENTS

| | | | |
|---|---|---|---|
| 1434003 | 4/1976 | United Kingdom | 339/98 |

OTHER PUBLICATIONS

"Terminal Boards", Kulka Electric Corp., Mount Vernon, N.Y., 1978, pp. 9, 25, 29, 33, 37, 41, 45, 53, 55, 59, 61, 63.

*Primary Examiner*—John McQuade
*Attorney, Agent, or Firm*—Gerald K. Kita

[57] ABSTRACT

A barrier block is disclosed which incorporates an electrical terminal in the form of a hollow cylindrical barrel provided with a longitudinal slot divided into one or more pairs of wire gripping jaws. The barrel is integral with a second electrical contact seatec on a web which interconnects a pair of partition walls. Opposite ends of the barrier block are molded with intermateable channels allowing a plurality of barrier blocks to be intermated and latched together.

5 Claims, 12 Drawing Figures

1
2
3
4
10
12
14
16
22
24
26
27
28
29
32
34
36
38
40
42
48
50
51
53
54
55
56
59
60
62
64
68
70
72
78

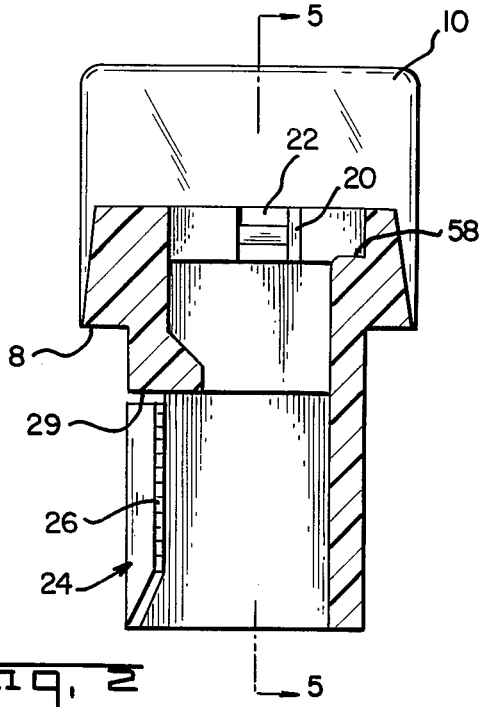
Fig. 2
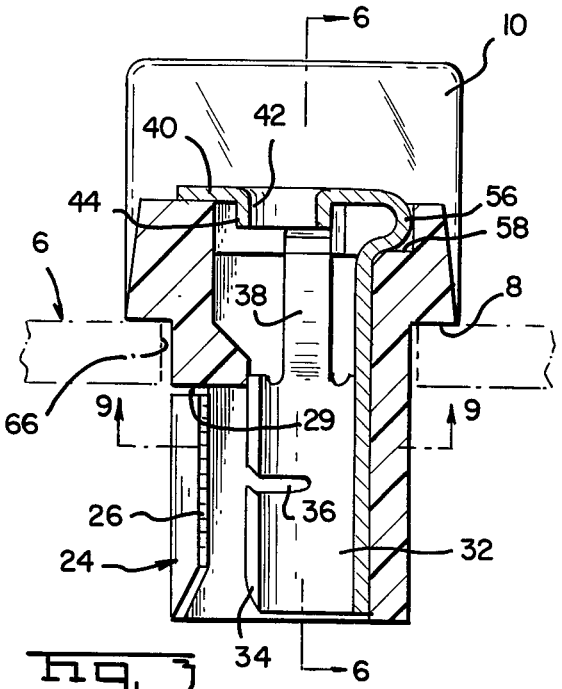
Fig. 3
Fig. 4
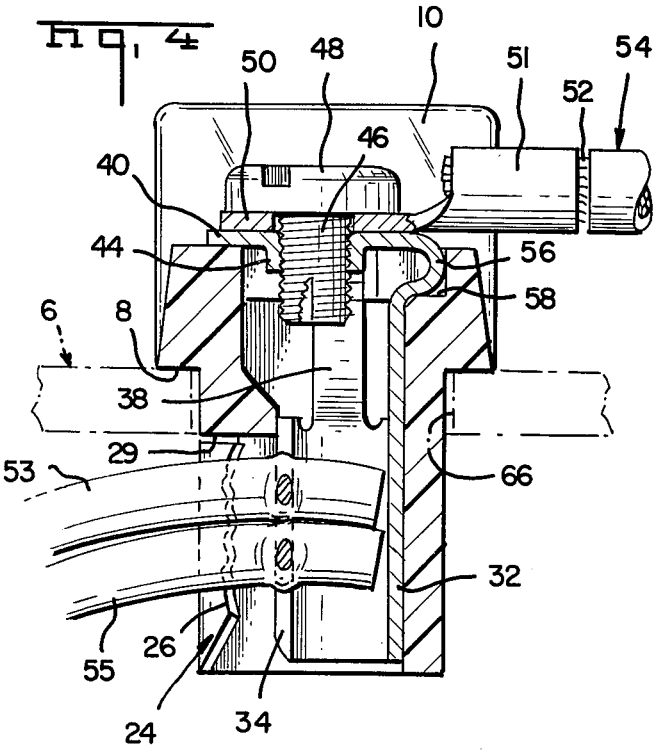
Fig. 5
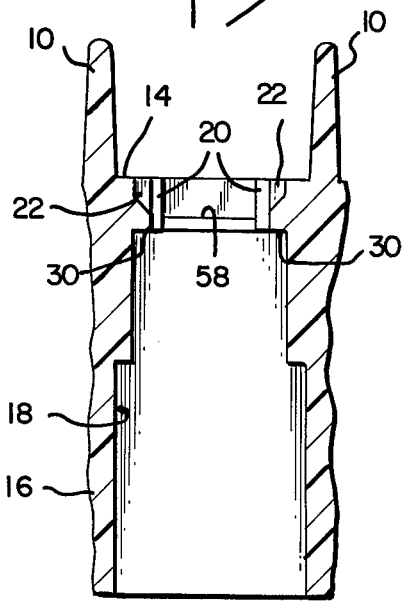

TERMINAL BLOCK

CROSS REFERENCE TO RELATED APPLICATION

This application is a continuation-in-part of application Ser. No. 047,840, filed June 12, 1979, now abandoned.

FIELD OF THE INVENTION

The invention relates to a junction block housing and a plurality of electrical terminals providing a central location to which incoming and outgoing wires are routed and electrically connected to one another with the terminals.

BACKGROUND OF THE INVENTION

A junction block is exemplified by U.S. Pat. No. 2,909,756 wherein a junction block base molded from a dielectric material is provided with mounting lugs receiving screws which secure the housing to a circuit board or panel. Individual wires are connected to electrical terminals mounted on the base. The wires are either directly attached to the terminals or are first connected to electrical contacts which are then secured to the terminals.

SUMMARY OF THE INVENTION

In a junction block according to the present invention individual barrel terminals are readily assembled to a junction block base and latched by spring tabs. The base is provided with a plurality of partition walls which serve as barriers between adjacent terminals. The base is molded with strain relief flanges with wavy edges providing a series of concavities which receive and which grippingly secure wires that are connected electrically to the terminals. Further, plural barrier blocks are capable of being linked together to allow selection of desired numbers of terminals and barrier blocks in a single stacked assembly.

Therefore, an object of the present invention is to provide a barrier block in which electrical terminals are readily assembled, and pairs of barrier blocks are readily assembled together.

Another object of the present invention is to provide a barrier block having a base provided with pairs of partition walls joined together by an interconnecting web into which an electrical terminal is readily assembled, with a pair or more barrier blocks capable of linking together to provide a selected number of terminals.

Another object of the present invention is to provide a barrier block capable of linking together with a like barrier block to provide a desired number of electrical terminals, the terminals themselves being readily assembled to the barrier block.

Another object of the present invention is to provide a modular barrier block incorporating an electrical terminal of the type having a cylindrical barrel provided with a longitudinal slot divided into one or more pairs of opposed wire engaging and gripping jaws, with the barrier block providing strain relief flanges with concavities for gripping therebetween one or more electrically connected into the slot of the barrel.

Other objects and advantages of the present invention will become aparent from the following detailed description and the accompanying drawings.

DRAWINGS

FIG. 2 is an enlarged section taken along the line 2—2 of FIG. 1.

FIG. 3 is an enlarged section taken along the line 3—3 of FIG. 2.

FIG. 4 is an enlarged section taken along the line 4—4 of FIG. 1.

FIG. 5 is an enlarged section taken along the line 5—5 of FIG. 2.

DETAILED DESCRIPTION

Figure 1:
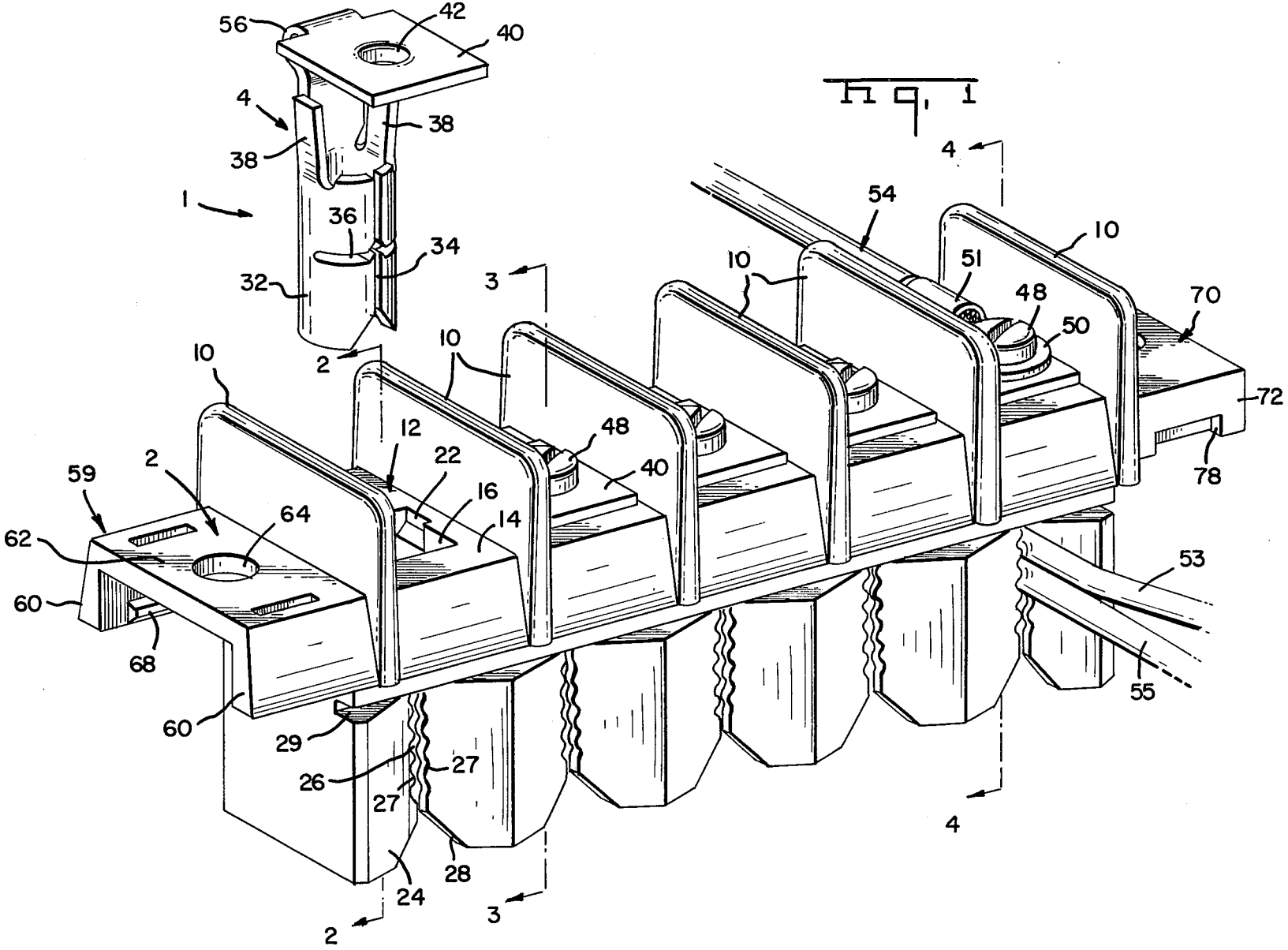
FIG. 1 is an enlarged perspective of a barrier block according to the present invention with selected components thereof in exploded configuration to illustrate the details thereof.

With more particular reference to the drawings, FIG. 1 illustrates a preferred embodiment of a barrier block indicated generally at 1 and including a base 2 which mounts a plurality of electrical terminals 4. The base is designed for mounting to a panel indicated generally at 6 in FIGS. 3, 4, 7 and 8.

Figure 6:
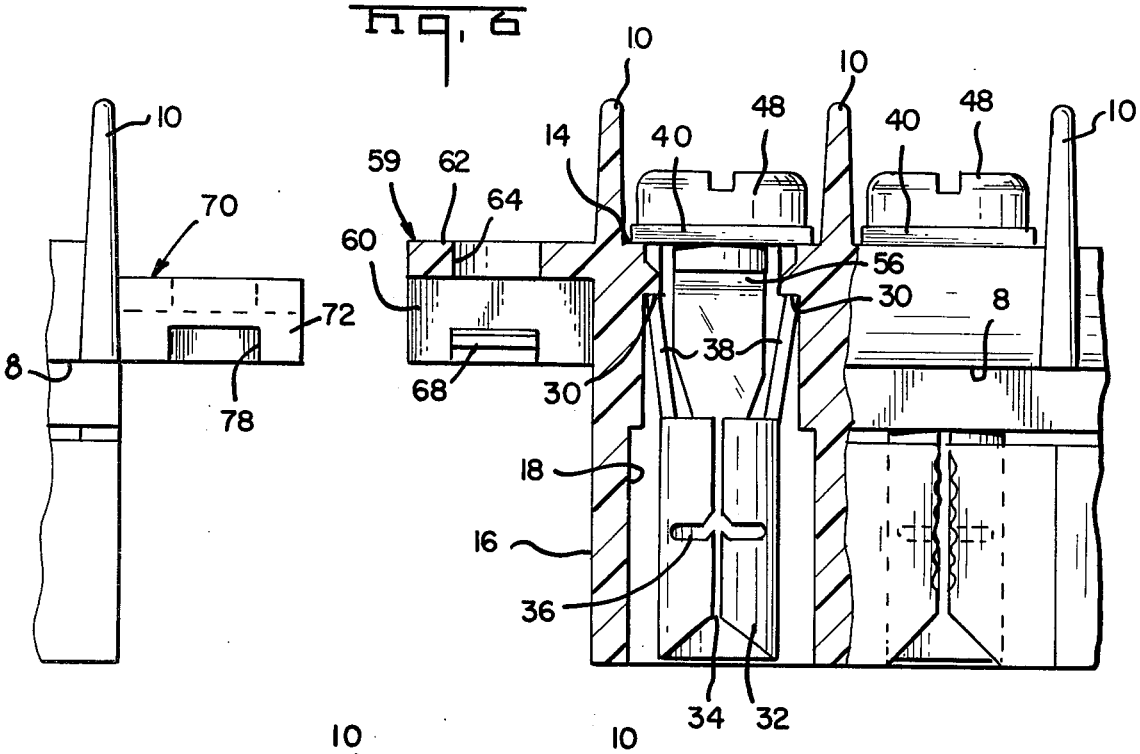
FIG. 6 is an enlarged section taken along the line 6—6 of FIG. 3.
Figure 7:
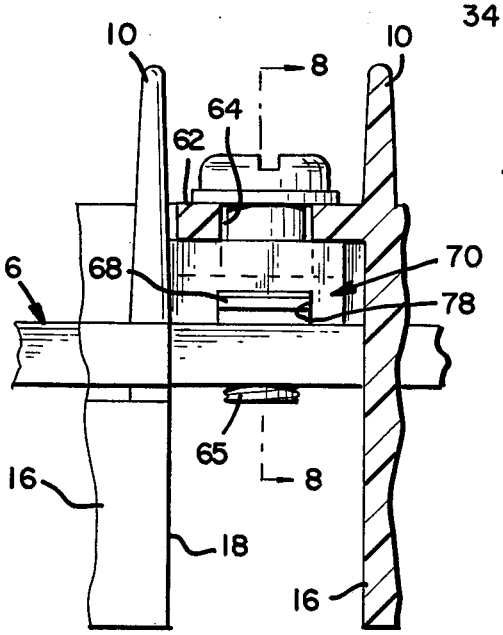
FIG. 7 is a view similar to FIG. 6 with a terminal present.

Details of the base are illustrated in FIGS. 2 through 9. The base is fabricated of a stiffly resilient dielectric material and is of unitary molded configuration with a bottom wall 8 and a plurality of generally rectangular partition walls 10. Adjacent partition walls 10 are interconnected by a vertically thick web 12 which provides a horizontal platform surface 14 and a relatively deep vertically depending section 16 having an enlarged stepped passageway 18 communicating with the platform 14. Relatively thin rectangular vertical grooves 20 are shown in FIG. 5 adjacent either side of a recess 18 and alongside corresponding partition walls 10. The grooves 20 are keyways for locking lances or tabs on the terminals as will be explained in detail. Each groove has a vertical tapered opening 22 in the corresponding surface 14. Each passageway 18 is bounded by a pair of flanges 24 separated by a vertical slot 26, with the sides of the slot having wavy outer edges 27 extending for a substantial vertical distance and then outwardly flaring away from each other to define a funnel entry 28 communicating with the slot. A clearance 29 through the flanges 24 separates the flanges from the bottom wall 8 and allows the edges 27 to deflect in a resilient hinge-like manner. A bottom accessible, wire receiving slot is defined between the flanges 24. As shown in FIGS. 5 and 6, each recess is provided with a pair of stepped shoulders 30 to provide for terminal locking in a manner to be described.

FIGS. 1, 3, 4, and 6 illustrate the details of the terminal 4. Each terminal 4 is stamped and formed from a single strip of conductive metal and is configured thereby with a hollow cylindrical barrel shaped electrical contact 32 generally of hollow sleeve form provided with a vertical longitudinal open seam or slot 34. Opposite sides of the slot 34 define wire engaging and gripping jaws. One or more transverse slots 36 divide the slot 34 into one or more pairs of opposed wire gripping jaws.

The barrel contact 32 is provided with a pair of integral tabs 38 oppositely projecting diagonally of the longitudinal axis of the barrel. FIG. 6 illustrates the ends of the tabs seated against the shoulders 30. Upon inserting the barrel portion downward vertically along the stepped opening 18, the tabs 38 are inserted along the openings 22 and are resiliently deflected toward each other to pass along the grooves 20. Once past the grooves, the tabs will spring outwardly to seat against the shoulders 30.

Further with reference to FIGS. 1, 3, 6, 7, and 8, the terminal 4 includes a planar plate portion 40 having a central opening 42 defined by forming a lip sleeve 44 which becomes internally threaded upon driving a threaded shaft 46 of a self-tapping screw 48 into the opening 42. A ring shaped terminal 50 has its sleeve 51 secured electrically to a conductor 52 of an insulated wire 54. The plate portion 40 is connected integrally by a loop portion 56 to the barrel contact. The loop projects radially outward of the barrel diameter and seats against a shoulder 58 in the stepped opening 18.

As shown in FIG. 4, a pair of wires 53 and 55 are electrically connected to the barrel by inserting end portions of the same transversely of their lengths slidably along the slot 34. Opposite sides of the slot comprise jaws which will slice through the insulation on each wire to engage and grip the conductor. In particular, the wire 53 will have its insulation sliced through and its conductor gripped between a first pair of opposed jaws defined on either side of the slot 34, and separated by the transverse slot 36 from a second pair of jaws on either side of the slot 34 which slice into and grip the wire 55. One slotted flange 24, shown in FIGS. 1, 3, and 4, will have its slot 26 in alignment with the barrel slot 34 to grip opposite sides of the wires and provide a strain relief. More specifically, the wires are inserted transversely of their lengths into the flange slot 26, the sides of the slot gripping the wires. The wavy edges 27 form a series of opposed concavities which render the edges more pliant to allow forcible passage of a wire along the slot without the edges slicing into the insulation of the wire, particularly a wire of relatively large gauge. Further, an inserted wire will register within a space defined between opposed concavities. The edges 27 thereby substantially will encircle the wire periphery and distribute a gripping force over the periphery being encircled. A wire of relatively small gauge will be securely held, as well as a range of larger gauge wires. The slot sides diagonally converge. If an inserted wire is pulled in a direction outwardly from the barrel terminal, the slot sides will tend to pivot in hinge-like fashion toward mutual alignment, narrowing the slot 26 to improve the grip on the wire and prevent its pull out from the terminal.

One end 59 of the base is of inverted channel configuration with sidewalls 60 connected by a bottom wall 62 having a central opening 64 for receiving a fastener 65 to secure the base to the board 6, with the bottom wall 8 in registration on the board and with the base sections 16 projecting through an appropriately provided aperture 66 through the board 6. The inwardly facing side walls 60 are molded with integral projecting latches 68.

Figure 8:
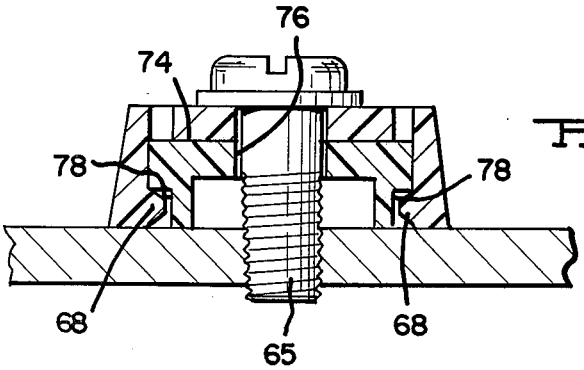
FIG. 8 is an enlarged fragmentary section taken along the line 8—8 of FIG. 7.
Figure 9:
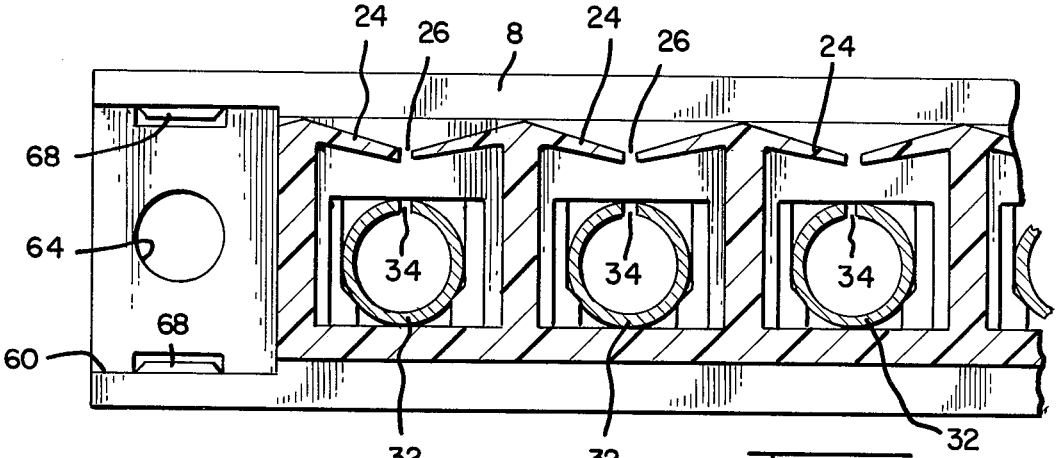
FIG. 9 is an enlarged fragmentary plan in section.

In FIG. 6, the opposite end 70 of the base is of inverted channel configuration constructed to interfit within a corresponding first channel of another like barrier block. The end 70 includes sidewalls 72 connected by an endwall 74 having a central aperture 76 to receive the fastener 65 as shown in FIG. 8. The side walls 72 are molded with recesses 78 in which the latches 68 register when the ends 59 and 70 are resiliently snapped together to intermate.

Figure 10:
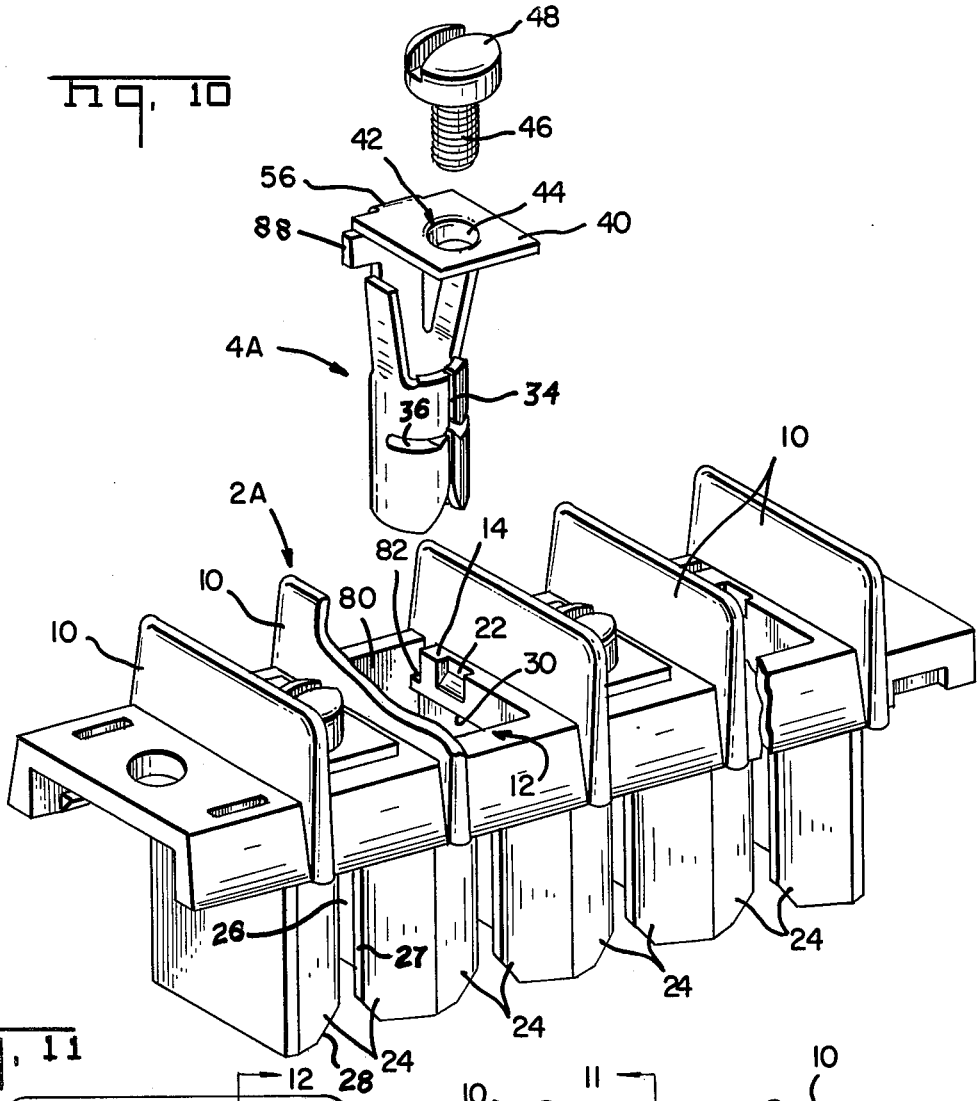
FIG. 10 is an enlarged fragmentary perspective of another preferred embodiment of a barrier block according to the invention with selected parts in exploded configuration to illustrate the details thereof.
Figure 11:
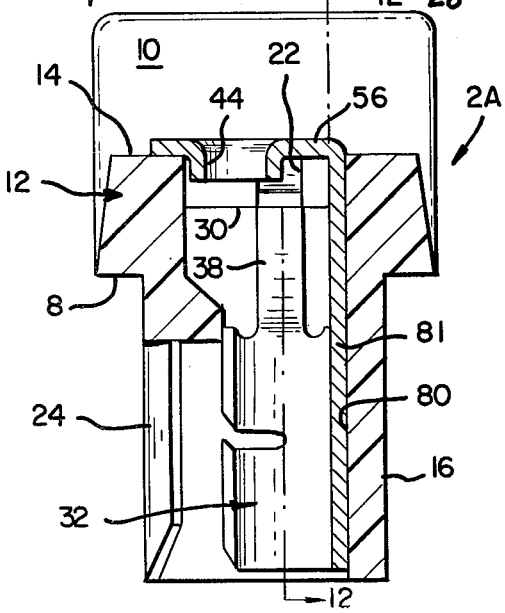
FIG. 11 is an enlarged section taken along the line 11—11 of FIG. 12.
Figure 12:
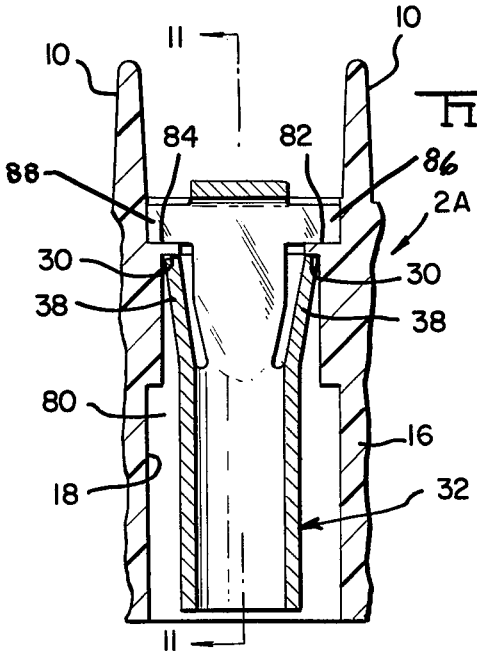
FIG. 12 is an enlarged section taken along the line 12—12 of FIG. 11.

FIGS. 10–12 illustrate a base 2A, which is similar to the barrier block base 2, with slight modifications to accommodate another preferred embodiment of a terminal 4A, which is similar to but distinguished from, the terminal 4. With reference to FIGS. 10–12, the modified base 2A will be described, with the same numerals used to refer to like parts in both the bases 2 and 2A. The base 2A is fabricated from a stiffly resiliently dielectric material and is of unitary molded configuration with a bottom wall 8 and a plurality of generally rectangular partition walls 10. Adjacent partition walls 10 are interconnected by a vertically thick web 12 which provides a horizontal platform surface 14 and a relatively deep vertically depending section 16 having an enlarged stepped passageway 18 communicating with the platform 14. This base 2A eliminates the rectangular vertical grooves 20, shown in FIG. 5 on the base 2. Each passageway 18 has a pair of vertical tapered openings 22 in the corresponding surface 14 similar to the openings 22 in the base 2. Each passageway 18 is bounded by a pair of flanges 24 separated by a vertical slot 26, with the sides of the slot having planar outer edges 27 extending for a substantial vertical distance and then outwardly flaring away from each other to define a funnel entry 28 communicating with the slot. The flanges 24 are connected to the bottom wall 8 to resist excessive deflection of the edges 27 in a resilient hinge-like manner. A bottom accessible, wire receiving slot is defined between the flanges 24. As shown in FIGS. 10 and 12, each recess is provided with a pair of stepped shoulders 30 to provide for terminal locking in a manner to be described.

As shown in FIG. 11, one side 80 of each recess is straight vertically and supports a straight length 81 of the terminal 4A. The side 80 opens into a pair of recesses 82 and 84 provided into the platform surface 14.

FIGS. 10–12 illustrate the details of the terminal 4A. Each terminal 4A is stamped and formed from a single strip of conductive metal and is configured thereby with a hollow cylindrical barrel shaped electrical contact 32 generally of hollow sleeve form provided with a vertical longitudinal open seam or slot 34. Opposite sides of the slot 34 define wire engaging and gripping jaws. One or more transverse slots 36 divide the slots 34 into one or more pairs of opposed wire gripping jaws.

The barrel contact 32 is provided with a pair of integral tabs 38 oppositely projecting diagonally of the longitudinal axis of the barrel. FIG. 12 illustrates the ends of the tabs seated against the shoulders 30. Upon inserting the barrel portion downward vertically along the stepped opening 18, the tabs 38 are inserted along the openings 22 and are resiliently deflected toward each other to pass into the passageway 18. Once in the passageway 18, the tabs will spring outwardly to seat against the shoulders 30.

Further with reference to FIGS. 10–12, the terminal 4 includes a planar plate portion 40 having a central opening 42 defined by forming a lip on sleeve 44 which becomes internally threaded upon driving a threaded shaft 46 of a self-tapping screw 48 into the opening 42. The plate portion 40 is connected integrally by a loop portion 56 to the barrel contact 32. The loop portion 56 then merges into the straight side 81 of the terminal 4A which is supported against the side 80 of the recess 18. The loop portion 56 additionally is provided with a pair of ears 86 and 88 which are inserted into the recesses 82 and 84 to prevent turning of the terminal 4A, as it is being inserted into the recess 18, and also after the tabs 38 have entered fully into the recess 18. The operation of the assembly of the terminal 4A and the base 2A is similar to the assembly of the terminal 4 and base 2.

Although a preferred embodiment of the present invention has been described and shown in detail, other modifications and embodiments which would be apparent to one having ordinary skill in the art intended to be covered by the spirit and scope of the claims.

What is claimed is:

1. A barrier block for commoning electrical wires or for providing a junction point for incoming and outgoing wires, comprising:

a housing having individual partition walls with adjacent pairs of said walls being interconnected by an integral web, an electrical terminal mounted on a respective web having a vertical hollow cylindrical barrel provided with a longitudinal slot divided into one or more pairs of opposed wire engaging and gripping jaws, each said terminal having a second wire receiving contact seated on a respective said web and connected to said barrel by an integral loop, strain relief flanges integral with said partition walls and having sides projecting diagonally toward each other, and defining therebetween a vertical wire receiving slot in alignment with said barrel slot, said sides having opposed wavy outer edges providing a series of wire receiving concavities.

2. The structure as recited in claim 1, wherein, said housing includes an inverted first channel having opposite side walls provided with projecting latches, and an inverted second channel constructed to interfit with a corresponding said first channel of another like barrier block, said second channel having opposite side walls provided with detents constructed for latching registration of latches provided on a first channel of another like barrier block.

3. The structure as recited in claim 1, wherein, said loop seats against a shoulder on said web.

4. A barrier block for commoning electrical wires or for providing a junction point for incoming and outgoing wires, comprising:

a housing having individual partition walls with adjacent pairs of said walls being interconnected by an integral web, an electrical terminal mounted on a respective web having a vertical hollow cylindrical barrel provided with a longitudinal slot divided into one or more pairs of opposed wire engaging and gripping jaws, each said terminal having a second wire receiving contact seated on a respective said web and connected to said barrel by an integral loop, strain relief flanges integral with said partition walls and having sides projecting diagonally toward each other, and defining therebetween a vertical wire receiving slot in alignment with said barrel slot, said loop having one or more projecting ears received in corresponding recesses provided in said web to prevent turning of said terminal.

5. The structure as recited in claim 4, wherein, said housing includes an inverted first channel having opposite side walls provided with projecting latches, and includes an inverted second channel constructed to interfit with a corresponding said first channel of another like barrier block, said second channel having opposite side walls provided with detents constructed for latching registration of latches provided on a first channel of another like barrier block.

* * * * *

UNITED STATES PATENT OFFICE

CERTIFICATE OF CORRECTION

Patent No. 4,236,778 Dated December 2, 1980

Inventor(s) Richard L. Hughes et al

It is certified that error appears in the above-identified patent and that said Letters Patent are hereby corrected as shown below:

Claim 5, line 4, delete "includes".

Signed and Sealed this

*Third* Day of *March 1981*

[SEAL]

*Attest:*

RENE D. TEGTMEYER

*Attesting Officer*

*Acting Commissioner of Patents and Trademarks*